United States Patent [19]

Kane et al.

[11] Patent Number: 4,761,621

[45] Date of Patent: Aug. 2, 1988

[54] CIRCULATOR/ISOLATOR RESONATOR

[75] Inventors: Robert C. Kane, Woodstock; Carl Kotecki, Palatine, both of Ill.

[73] Assignee: Motorola, Inc., Schaumburg, Ill.

[21] Appl. No.: 880,220

[22] Filed: Jun. 30, 1986

[51] Int. Cl.[4] ..... H01P 1/387

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 3,277,400 | 10/1966 | Digiondomenico et al. . | |
| 3,521,195 | 7/1970 | Bosma | 333/1.1 |
| 3,636,479 | 1/1972 | Hartz et al. . | |
| 3,673,518 | 6/1972 | Carr . | |
| 3,733,563 | 5/1973 | Poirier . | |
| 3,772,615 | 11/1973 | Nishiyama . | |
| 4,016,510 | 4/1977 | Hodges, III et al. . | |
| 4,174,506 | 11/1979 | Ogawa | 333/1.1 |
| 4,210,886 | 7/1980 | Enderby et al. . | |
| 4,246,552 | 1/1981 | Fukasawa et al. . | |
| 4,496,915 | 1/1985 | Mathew et al. . | |

FOREIGN PATENT DOCUMENTS

| | | |
|---|---|---|
| 1280354 | 10/1968 | Fed. Rep. of Germany . |
| 2401188 | 10/1974 | Fed. Rep. of Germany . |
| 55-83302 | 6/1980 | Japan . |
| 1428384 | 3/1976 | United Kingdom . |
| 204399 | 1/1968 | U.S.S.R. . |
| 208044 | 3/1968 | U.S.S.R. . |
| 557046 | 7/1977 | U.S.S.R. . |

OTHER PUBLICATIONS

Knerr, "A Microwave Circulator That's Smaller Than a Quarter", Bell Laboratories Record, vol. 51, No. 3, Mar. 1973, pp. 79–84.

Dydyk, "Take Two Steps Toward Better Circulator Design", Microwaves, Mar. 1979, pp. 53–62.

Helszajn et al., Characteristics of Circulators Using Planar Triangular and Disk Resonators Symmetrically Loaded with Magnetic Ridges", IEEE Transactions on Microwave Theory and Techniques, vol. MIT-28, No. 6, Jun. 1980, pp. 616–621.

*Primary Examiner*—Paul Gensler

*Attorney, Agent, or Firm*—Raymond A. Jenski; Rolland R. Hackbart

[57] ABSTRACT

A microstrip resonator (311) for a circulator/isolator is disclosed employing radial (815, 817, and 819) and circumferential (821, 823, and 825) slots to load the resonator and reduce the frequency of resonance. A resonator of small physical size is thus formed having a discontinuous outer ring (segments 807, 809, and 811) and a central triangle portion (827) each electromagnetically coupled to a ferrite element.

5 Claims, 9 Drawing Sheets

—PRIOR ART—

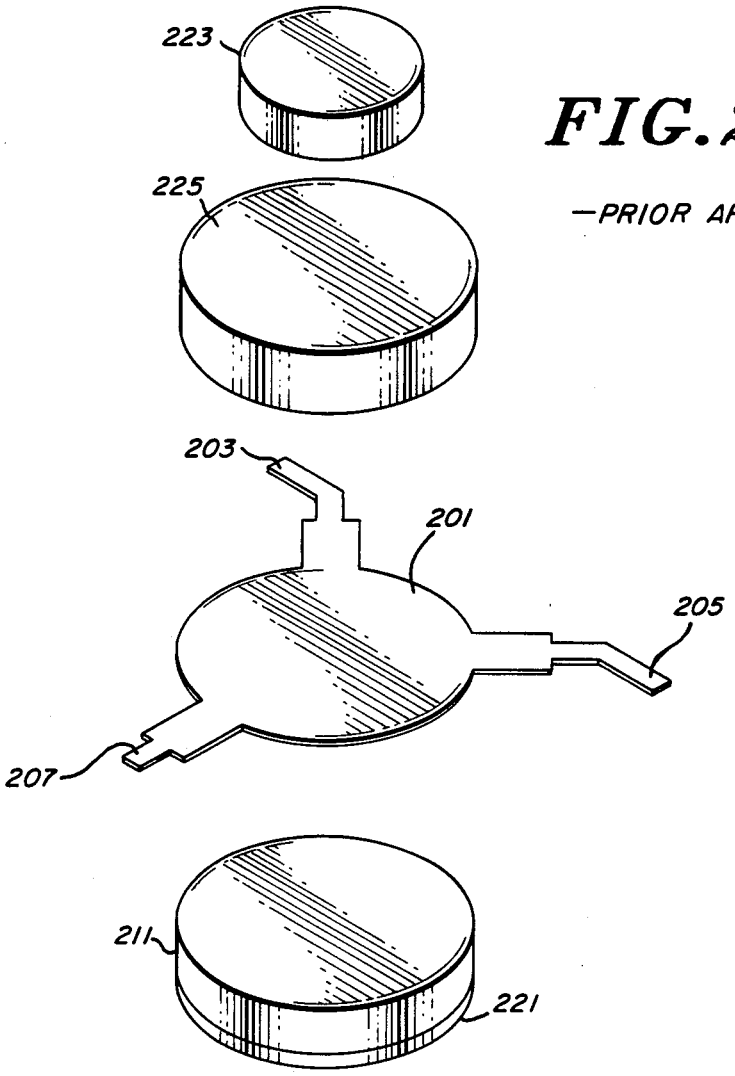
FIG. 2A
—PRIOR ART—
FIG. 2B
—PRIOR ART—
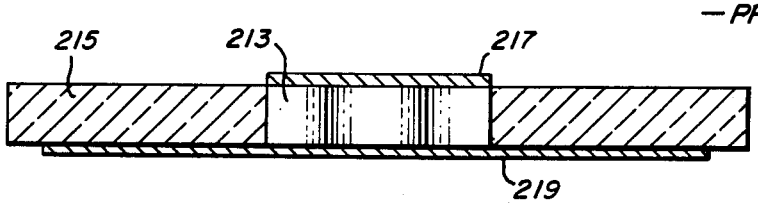

FIG. 3B
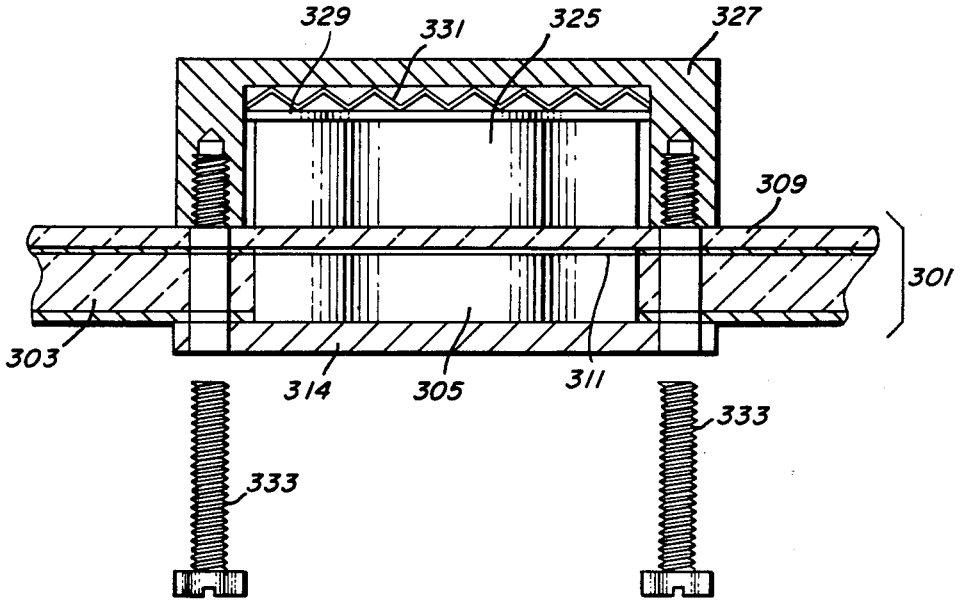
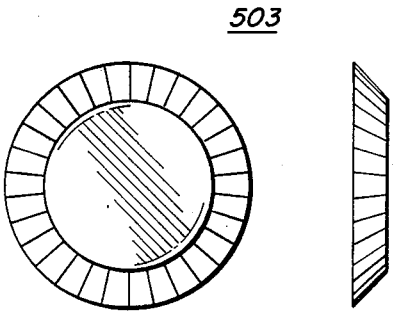
FIG. 6

FIG. 8A
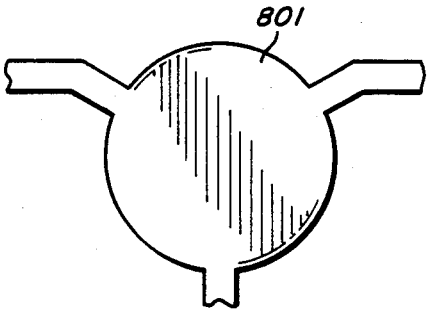
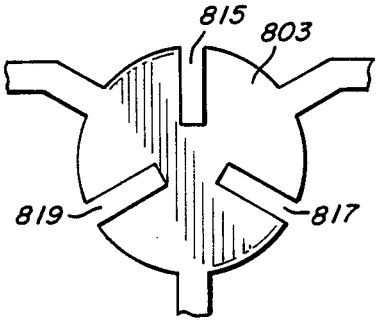
FIG. 8B
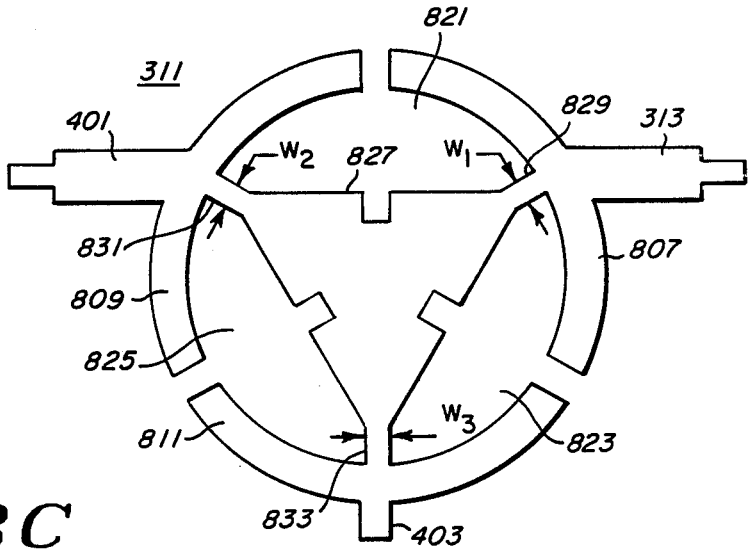
FIG. 8C

CIRCULATOR/ISOLATOR RESONATOR

BACKGROUND OF THE INVENTION

This invention relates generally to non-reciprocal radio frequency devices and more particularly to a distributed element resonator for circulators and isolators which substantially reduces the volume of the device. Reference is made to copending patent application Ser. No. 880,221 "Microstrip Circulator with Ferrite and Resonator in Printed Circuit Laminate" filed on behalf of Robert C. Kane on the same date as the present invention and containing related subject matter.

Circulators and isolators are well known radio frequency devices which exhibit non-reciprocal properties. A common form of circulator is that of a three-port device which couples a radio frequency signal from a first port to a second port with virtually no attenuation of the signal but which significantly attenuates a signal coupled from the second port to the first port. The signal applied at the second port is coupled to a third port. Likewise, a signal applied at the third port is coupled to the first port but greatly attenuated at the second port. Thus, the effect of the circulator is to isolate the ports from each other in one direction (i.e. ports 1-3-2-1) and to couple the ports sequentially to each other in the other direction (ports 1-2-3-1).

Physical construction of circulators can be realized in resonant structures such as radio frequency resonant cavities and in waveguide at higher frequencies. Circulators may also be realized as "Y" junction circulations in planar configuration using stripline or microstrip technology which employ a planar resonating element between two ground plane conductors (stripline) or coupled to a single ground plane conductor (microstrip).

A distributed element (microstrip or stripline) circulator is typically constructed of an essentially planar resonating element having regularly spaced ports coupled to the periphery of the resonating element (resonator). The resonator is closely coupled to one or more elements exhibiting gyromagnetic properties (typically a ferrite material) and a magnetic field is applied perpendicular to the resonator and through the ferrite. When a radio frequency signal is applied at one port, the ferrite atoms, which have their magnetic spin vectors preferentially aligned along the magnetic lines, precess in one rotational direction. This precession favors coupling of the radio frequency signal from the port of application to the next port in the direction of the spin precession.

The preferential coupling of radio frequency signal from one port to another may be employed in a more particular application of a circulator known as an isolator. An isolator has one of the ports terminated in a resistance which matches the characteristic impedance of the circulator. This device permits radio frequency signal to propagate in one direction but blocks the propagation in the opposite direction (because the radio frequency signal energy is dissipated in the terminating resistance). This device also presents a relatively constant impedance to both the input and the output ports. Consequently, isolators are used extensively in radio transmitters and receivers where the impedance presented to an amplifying stage must be maintained close to the input or output impedance of the stage or where reflected energy could produce undesired effects or damage.

The quality of circulators and isolators is generally measured by the insertion loss in the direction of signal coupling, the amount of attenuation in the opposite direction, the impedance of each port, and the band of frequencies over which these characteristics are maintained. Optimization of these characteristics is the goal of circulator designers and has resulted in increasingly complex and expensive techniques of aligning the resonator, the ferrite, and the magnet. Additionally, reduction in circulator and isolator size without corresponding degradation in quality of performance has become important with reduced size and portability of mobile radiotelephones.

SUMMARY OF THE INVENTION

Therefore, it is one object of the present invention to reduce the size of the circulator or isolator.

It is a further object of the present invention to simply and easily enable the alignment of the resonator, the ferrite, and the magnet of a circulator or isolator.

It is a further object of the present invention to reduce the impedance mismatch at the ports of the circulator or isolator.

Accordingly, these and other objects are achieved in the present invention which encompasses a distributed element resonator for a circulator or isolator employing a planar electrical conductor having three port leads and a substantially circular resonant member. The resonant member comprises a discontinuous outer ring and a centered inner triangle. The outer ring is coupled to each of the port leads at predetermined angular intervals along the outer circumference of the ring and coupled to a respective vertex of the triangle at the predetermined angular intervals along the inner circumference of the ring. The discontinuous ring has interruptions at substantially the bisection of the angular interval between each port lead and the triangle has slots extending toward the center of the resonant element on a radius common with the predetermined angular interval bisection. The ferrite elements of the circulator/isolator are disposed substantially opposite the resonant member and electromagnetically coupled to at least all of the discontinuous outer ring.

BRIEF DESCRIPTION OF THE DRAWINGS

FIG. 2A is an exploded perspective view of a conventional microstrip circulator.

FIG. 2B is a cross sectional view of a conventional microstrip circulator in which the ferrite is embedded in the substrate.

FIG. 3B is a cross sectional view of a preferred embodiment of the present invention employing a single permanent magnet for biasing of a microstrip circulator.

FIG. 6. is a diagram of a shim which may be employed in the present invention.

FIGS. 8A, 8B, and 8C show resonator configurations which culminate in the configuration of FIG. 8C employed in the present invention.

DESCRIPTION OF THE PREFERRED EMBODIMENT

Figure 1:
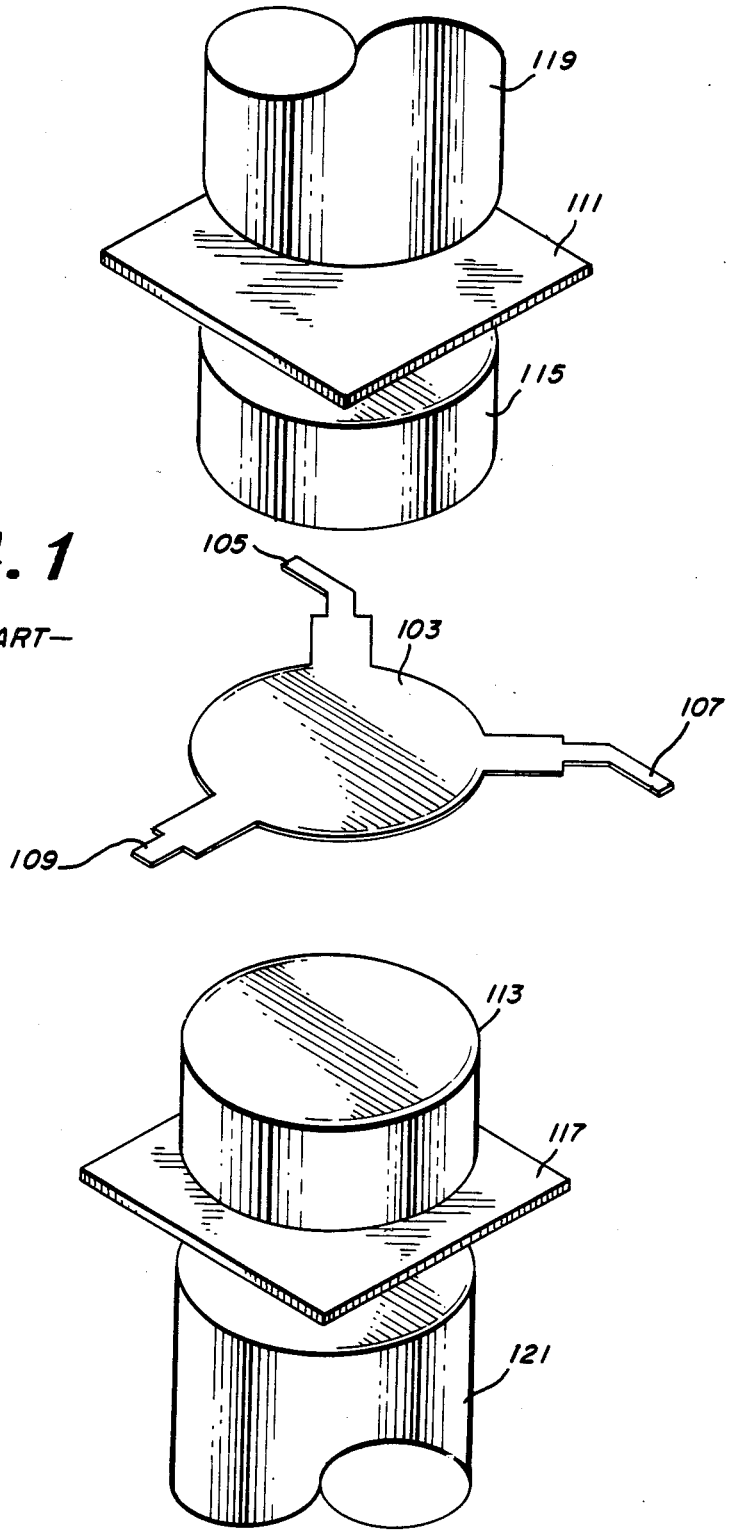
FIG. 1 is an exploded perspective view of conventional stripline circulator construction.

A conventional circulator employing stripline construction is shown in FIG. 1. This construction typically employs conductive resonator 103 coupled to external circuitry via input/output port leads 105, 107, and 109. Gyromagnetic material forms the dielectric between the resonator 103 and ground planes above (111) and below (117) the resonator 103, and is usually several pieces of ferrite, shown here as ferrites 115 and 113. The sandwich of ferrites 115 and 113 and resonator 103 along with ground planes 111 and 117 are secured between opposite poles of a biasing magnet shown as magnets 119 and 121. Depending upon particular requirements of the circulator, a high permeability spacer (not shown) may be used to focus or spread the magnetic field. Additionally, a high permeability housing is typically used to contain the sub-components of the device and direct the field of the biasing magnet.

A conventional microstrip circulator is shown in FIG. 2A. In this implementation, a resonator 201 and input/output port leads 203, 205, and 207 may be realized as a discrete sub-component. Other implementations may have the resonator 201 metalized on a substrate, metalized directly upon the ferrite material 211, or utilize a precision fit between ferrite 213 and substrate 215 as shown in cross section in FIG. 2B. (The resonator 217 is metalized over the fitted ferrite 213 on one face of the substrate and a ground plane 219 is metalized over the interface between ferrite 213 and substrate 215 on the opposite substrate face). Considering again the circulator of FIG. 2A, the microstrip ground plane 221 is typically metalized on the ferrite 211 opposite the resonator 201. One or more magnets, shown as 223, provide magnetic bias for the ferrite 211 and may be separated from the resonator 201 by a non-magnetic spacer 225.

Figure 3A:
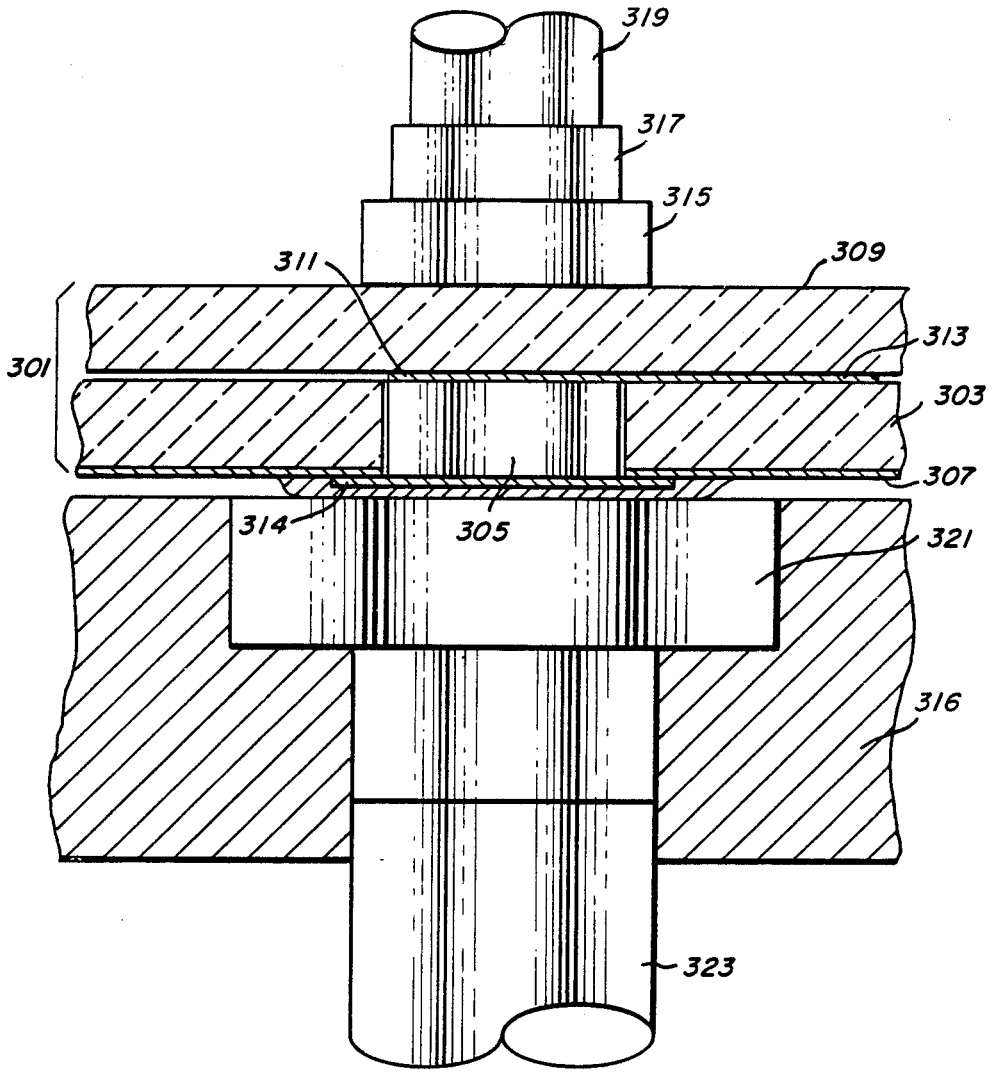
FIG. 3A is a cross sectional view of one preferred embodiment of a microstrip circulator employing the present invention.

A cross-section of the circulator employing the resonator of the present invention in an embodiment employing a rigid mounting surface and an electromagnet is shown in FIG. 3A. (Construction of an isolator could be identical although one of the circulator ports would be terminated in a resistance equal to the characteristic impedance of the circulator). In order that the circulator of the present invention simplify alignment of the various components during construction and maintain optimum match between the output ports of the circulator and external circuit components, a multilayer printed circuit board 301 is employed. One of the laminations 303 (or layers) of printed circuit board 301 is fabricated with a hole from one side of the lamination 303 to the other such that a ferrite 305 may be emplaced in this area. In the present invention, the class of fit between the ferrite 305 and the lamination 303 is not critical. It is desirable that the ferrite 305 be easily inserted and removed from the hole; consequently, the preferred embodiment uses a clearance of at least 0.001 inch between ferrite and substrate. This loose fit could not be tolerated in earlier designs employing ferrite embedded in a substrate. Additionally, one side of the lamination 303 may be metalized to provide a ground plane 307.

A second lamination 309 of the printed circuit board 301 is metalized with the circulator resonator 311 and its port leads 313. Lamination 309 is held in contact with lamination 303 by conventional bonding techniques used for multi-laminate printed circuit board fabrication in the preferred embodiment and the resonator 311 is aligned and held into close contact with ferrite 305 by securing a conducting bottom plate 314 to the ground plane 307 by solder, by compression of the circulator assembly with the magnet pole pieces 319 and 323, or other means.

In order to reduce the losses through the capacitance formed by resonator 311 and pole piece 319, a dielectric insulating spacer 315 may be interposed between pole piece 319 and the printed circuit board assembly 301. A steel insert 321 aids in the completion of the magnetic circuit to the pole piece 323. The entire assembly may then be secured to an aluminum chassis 316 for mechanical stability. A spacer 317 may be used to further aid in distributing the magnetic field.

The embodiment illustrated in FIG. 3A is particularly useful when pole pieces 319 and 323 are parts of an electromagnet. Pole pieces 319 and 323 may alternatively be realized as permanent magnets. The use of permanent magnets for bias enables a further simplification in the design of a circulator employing the present invention.

The cross sectional diagram of FIG. 3B shows a microstrip embodiment of the present invention employing a permanent magnet 325. A high permeability housing 327 and conducting plate 314 are secured to the multilaminate printed circuit board 301 and each other to provide mechanical stability to the circulator. Copper and cold rolled steel (CRS) shims 329 are employed to tune and distribute the magnetic bias field. A CRS spring 331 is used to hold the ferrite 305 in contact with the resonator 311 when housing 327 is assembled using high permeability fasteners 333.

Figure 3C:
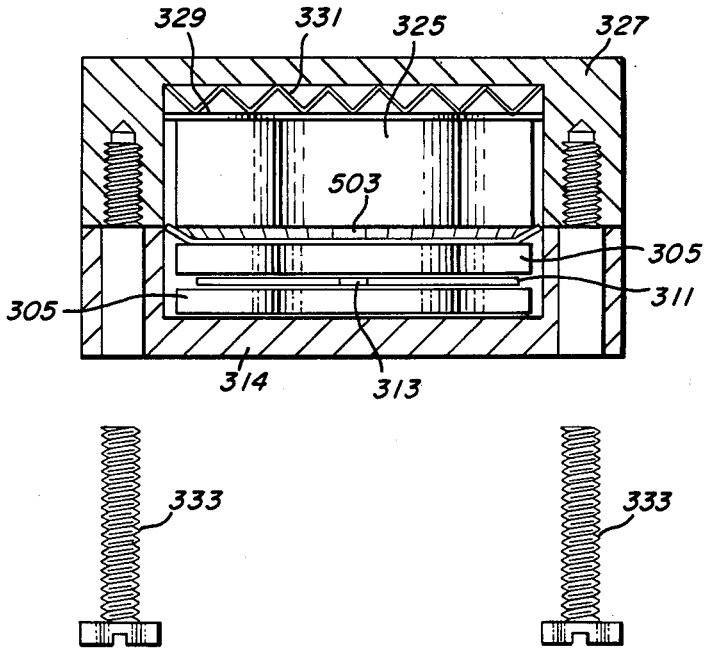
FIG. 3C is a cross sectional view of a preferred embodiment of the present invention employing a single permanent magnet for biasing of a stripline circulator.

A stripline embodiment of a circulator employing the present invention is shown in cross section in FIG. 3C. A permanent magnet 325 is housed in a permeable housing comprising sections 314 and 327. The resonator 311 of the present invention is sandwiched between two ferrite elements 305 and connected to external circuitry through port leads (port lead 313 is visible in FIG. 3C). Like the microstrip embodiment of FIG. 3B, copper and cold rolled steel (CRS) shims 329 are employed to tune and distribute the magnetic bias field. The CRS spring 331 holds the ferrites 305 in contact with the resonator 311 such that the entire surface of the resonator is coupled to the ferrites 305. Also a shim 503 is inserted between magnet 325 and one ferrite 305 to provide a positive electrical contact between the ferrite 305 and the housing 314. A stripline embodiment of the invention yields a circulator with the least physical volume.

Figure 4A:
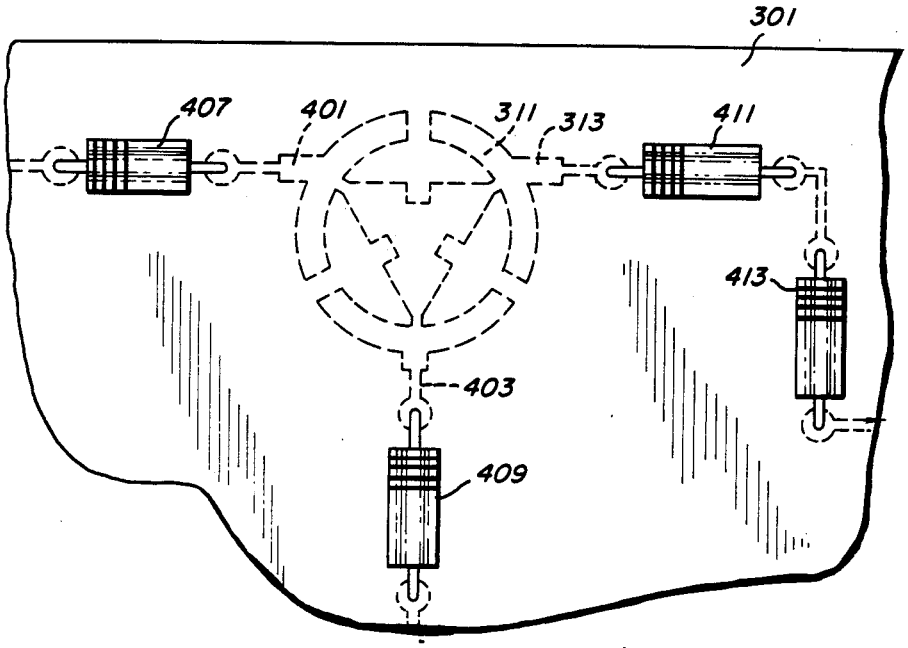
FIG. 4A is a top view of the printed circuit board illustrating the resonator of the present invention coupled to external components.
Figure 4B:
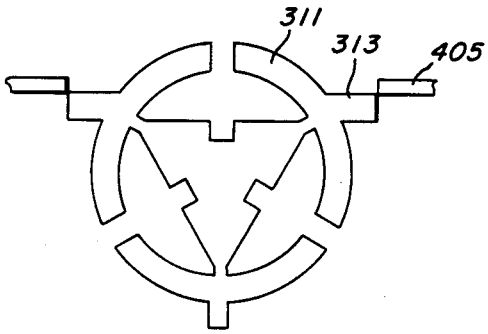
FIG. 4B is a bottom view of the resonator of the present invention showing the port leads misaligned, a condition which the present invention alleviates.

Referring now to FIG. 4A, a section of laminated printed circuit board 301 is shown in top view. One of the features of a microstrip embodiment of the present invention is that the port leads 313, 401, and 403 of the circulator resonator 311 may be arranged such that impedance mismatch is minimized. Since the port leads and the resonator 311 are formed as part of the metalization of the entire circuit board, there is no mismatch due to improper port lead placement as indicated in FIG. 4B. FIG. 4B illustrates potential misalignment of port lead 313 and external circuit connection 405 which is possible for a non-integral resonator 311, i.e. not metalized as part of the external circuit. Other translational and rotational misalignments were also possible before the solution provided by the present invention. Further, as shown in FIG. 4A, associated circuitry shown as external components 407, 409, 411, and 413, for example, may be added to the topside of printed circuit board 301 thereby incorporating the circulator resonator 311 directly into the associated circuitry without the need for terminating connectors or tabs. Thus, an entire electronic assembly including a circulator may be fabricated on a single multilaminate printed circuit board with components on one side of a layer, a metalized resonator as part of the printed circuit wiring on a second side of a layer, and in physical contact with a ferrite located in a second layer of the printed circuit board 301.

Figure 5:
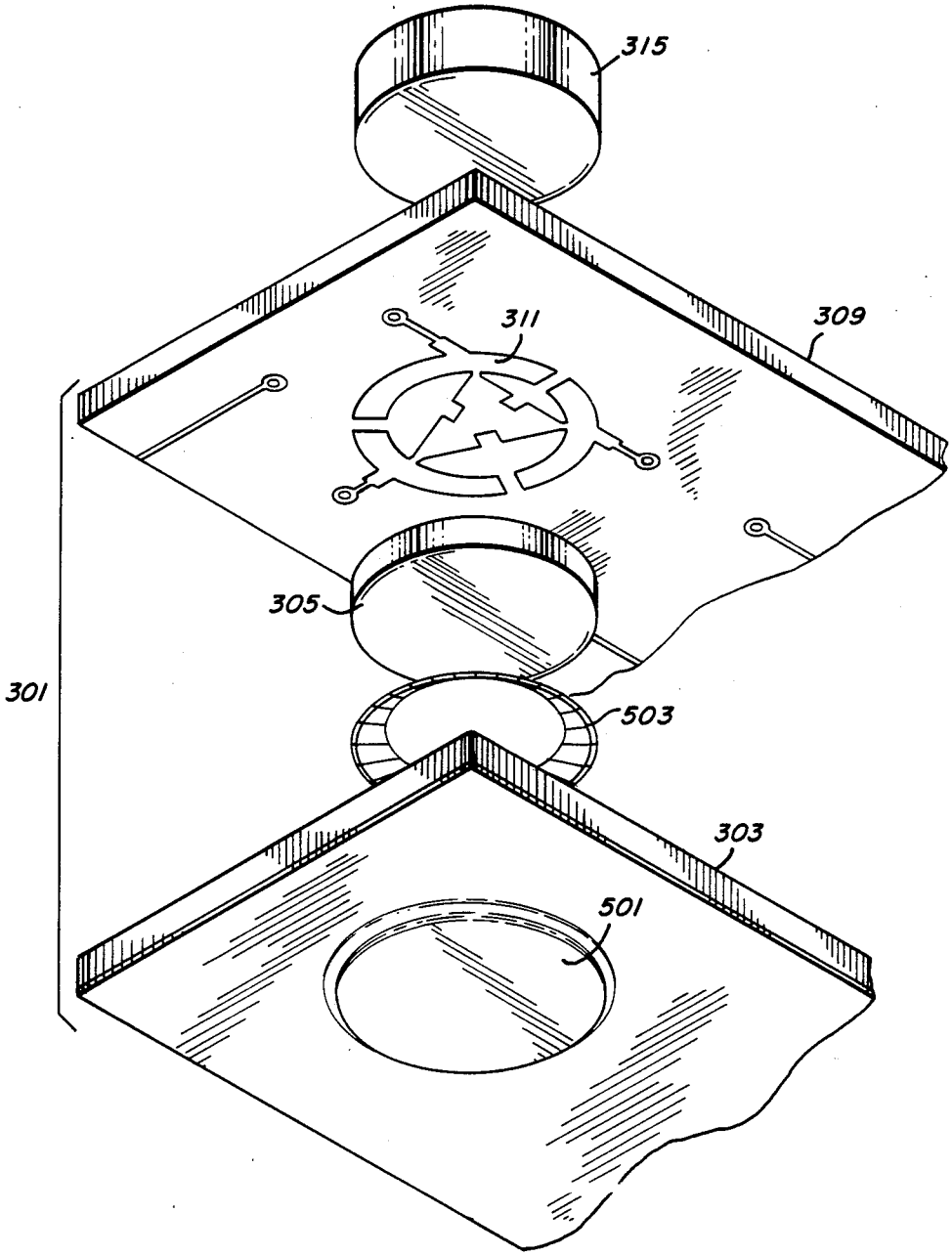
FIG. 5 is a bottom exploded perspective view of the microstrip circulator of the present invention showing two laminations of the circuit board and the relative locations of the resonator and ferrite.
Figure 7A:
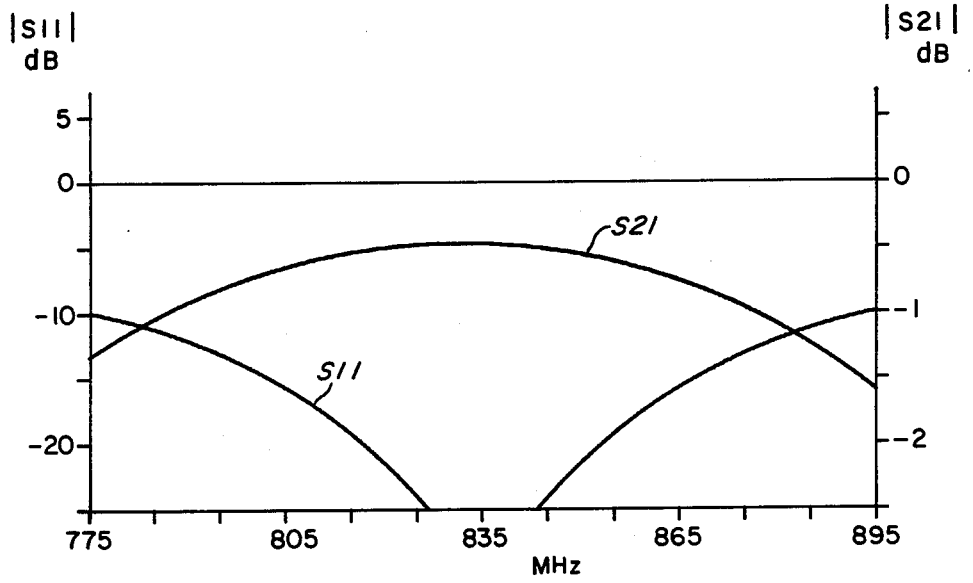
FIGS. 7A and 7B are graphs plotting the magnitude of the scattering parameters of a stripline isolator employing the present invention.
Figure 7B:
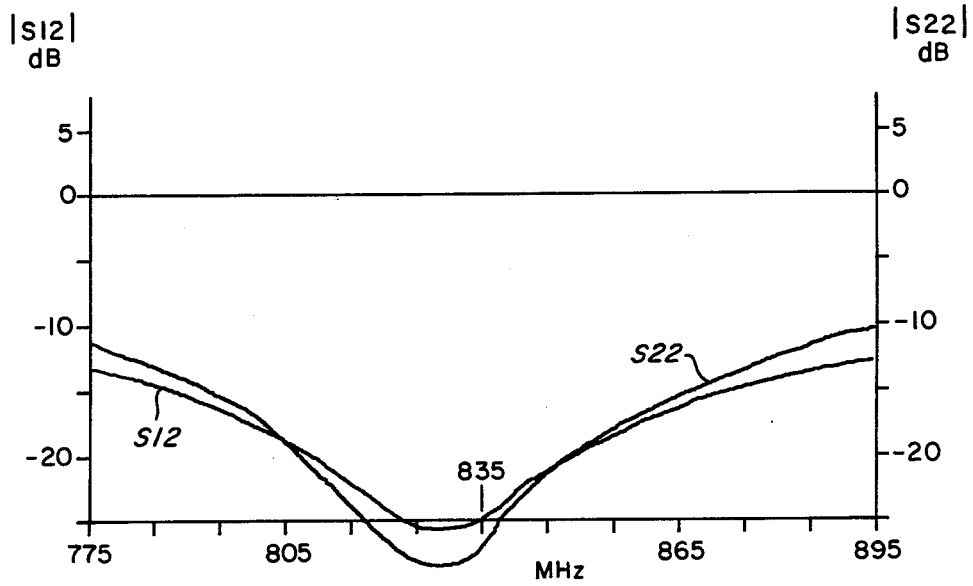

A bottom exploded perspective view of a microstrip circulator employing the present invention is shown in FIG. 5. Here, it can be seen that the ferrite 305 is carried in lamination 303 and in physical contact with the resonator 311 metalized on layer 309 of the printed circuit board 301. Locating ferrite 305 in a hole in lamination 303 permits effective coupling of energy between the ports of the circulator. In a preferred embodiment of the present invention, a permeable metal backer 501 is added to the bottom ground plane of layer 303 to support the ferrite 305 and provide the necessary ground plane for the microstrip circulator resonator 311. Additionally, a copper plated CRS shim stock 503 shown in FIG. 6 may be disposed between the ferrite and metal backer 501. Shim stock 503 is a circular piece with a serrated dished edge formed to maintain positive electrical contact with the ground plane. When placed in compression, the serrated edge is forced outward against its mounting hole thus affording a positive electrical contact with the conducting sides of the hole.

Performance of a stripline circulator constructed in accordance with the present invention is shown in the scattering parameter graphs of 7A and 7B. When tuned for an operating center frequency of 835 MHz, and employing a brass resonator having a 0.290 inch radius and a 0.656 inch diameter ferrite with a dielectric constant of 15, an insertion loss ($S_{21}$) equal or less than −0.5 db was achieved over the band of 812 MHz to 851 MHz. Additionally, a reverse isolation ($S_{12}$) exceeded −18 dB over the same frequency range.

Tuning of the frequency of operation of a circulator is primarily accomplished by selection of the physical dimensions of the resonator and the dielectric constants of the materials within the field between the resonator and its ground plane. For a conventional resonator in the UHF frequency range such as that shown as resonator 801 in FIG. 8A, the resonator diameter of a solid plane resonator having a resonant frequency of 835 MHz would be approximately 2 inches. Literature discussing the subject of magnetic ridge loading has indicated that radial slots could be cut in the resonator at locations which correspond with magnetic walls set up in the electromagnetic field when the resonator is excited by a radio frequency signal at the resonance frequency of the circulator. Such radial slots, shown in resonator 803 of FIG. 8B, magnetically load the resonator such that the frequency of resonance of a resonator of a given size is effectively reduced. Thus, a small circulator may be designed utilizing radial slots. In the preferred embodiment the optimum slot depth is reached when the radial slots extend to a depth of 0.8 radius.

The use of circumferential slots and their effect on the resonant frequency had not been analyzed until the present invention combined circumferential slots in the resonator proper with radial slots in a configuration for a resonator 311 as shown in FIG. 8C. This combination realizes an optimum loading of radial and circumferential slots, resulting in a stripline resonator diameter reduction to 0.580 inches for operation over a band of frequencies from 815 MHz to 850 MHz.

A resonator for a circulator or isolator, then, constructed in accordance with the present invention would utilize a circulator resonator 311 such as that shown in FIG. 8C. The input/output port leads (313, 401, and 403) in the preferred embodiment are coupled to the outer circumference of the circulator resonator 311 at 120° intervals. The circular resonator 311 itself consists of a discontinuous outer ring of segments 807, 809, and 811 which are interrupted at points which are on the bisection of the 120° angle between the input/output port lead connections. These interruptions correspond to radial slots 815, 817, and 819 in the resonator 803 of FIG. 8B and in the preferred embodiment have a width of 0.06 inches. In addition, circumferential slots 821, 823, and 825 are cut in the preferred resonator of FIG. 8C. These circumferential slots form the inner circumference of the ring and produce a ring width of 0.06 inches in the preferred embodiment. The circumferential slot utilizes a chord of the circular resonator perpendicular to respective radial slots to determine the inner dimension. Thus a conducting triangle portion 827 is formed at the center of the circular resonator 311 and has each respective vertex of triangle 827 connected by a feed line (829, 831, and 833) to the inner circumference of the discontinuous ring at the point of connection of each input/output port lead. In the preferred embodiment, the triangle 827 has equilateral dimensions and a vertex radius of 0.220 inches. The feed lines were made nonsymmetical to improve $S_{12}$ and $S_{21}$, and the preferred embodiment employs a width $W_2$ (of FIG. 8C) of 0.020 inch for feedline 831 (isolator input), a width of $W_1$ of 0.050 inch for feedline 829 (isolator output), and a width of $W_3$ of 0.030 inch for feedline 833 (terminated).

In summary, then, a physically small circulator/isolator operating in the UHF band has been realized in distributed element technology. The size of the resonator has been reduced by introducing radial slots into the resonator as a loading mechanism. Additionally, increased ridge loading is accomplished by means of novel circumferential slots extending symmetrically from the radial slots within the resonator proper. Because of its small size, this circulator/isolator may be constructed using a multilayer laminate printed circuit board. Such construction enables the port leads of the device to be formed as part of the metalization of the printed circuit board and termination mismatch due to misalignment of the port leads with external circuitry is eliminated. Therefore, while a particular embodiment of the invention has been shown and described, it should be understood that the invention is not limited thereto since modifications unrelated to the true spirit and scope of the invention may be made by those skilled in the art. It is therefore contemplated to cover the present invention and any and all such modifications by the claims of the present invention.

We claim:

1. A resonator for a microstrip non-reciprocal radio frequency device comprising:

a planar electrical conductor having three port leads and a substantially circular resonant member comprising a discontinuous outer ring and a centered inner triangle, said ring coupled to said port leads at predetermined angular intervals along the outer circumference of said ring and coupled to a respective vertex of said triangle at each said predetermined angular interval along the inner circumference of said ring, said discontinuous ring having interruptions at substantially the bisection of said angular interval between each said port lead and said triangle having non-conducting slots extending toward the center on each radius common with said bisection; and at least one transversely magnetized ferrite element disposed substantially opposite said circular resonant member and including said discontinuous outer ring and inner triangle within an area bounded by the periphery of said ferrite element whereby said ferrite element is electromagnetically coupled to at least all of said discontinuous outer ring and inner triangle.

2. A resonator in accordance with claim 1 wherein a first side of said at least one ferrite element contacts said resonant member.

3. A resonator in accordance with claim 2 further comprising a ground plane disposed along a second side of said at least one ferrite element and parallel to said planar electrical conductor.

4. A resonator in accordance with claim 1 further comprising feed lines coupling said discontinuous ring to each said respective vertex of said triangle at each said predetermined angular interval along the inner circumference of said discontinuous ring.

5. A resonator in accordance with claim 4 wherein said feed lines are of dissimilar widths.

* * * * *